United States Patent [19]

Richardt et al.

[11] Patent Number: 4,745,789

[45] Date of Patent: May 24, 1988

[54] APPARATUS FOR SEPARATING PRESSURE PLATES FROM EXTRUSION RESIDUES OF METAL EXTRUDED WITH A SHELL

[75] Inventors: Urban Richardt; Josef Ahrweiler, both of Mettmann, Fed. Rep. of Germany

[73] Assignee: SMS Hasenclever Maschinenfabrik GmbH, Dusseldorf, Fed. Rep. of Germany

[21] Appl. No.: 933,911

[22] Filed: Nov. 24, 1986

[30] Foreign Application Priority Data

Nov. 29, 1985 [DE] Fed. Rep. of Germany ..... 3542237

[51] Int. Cl.[4] ..... B21C 35/04

[52] U.S. Cl. ..... 72/255

[58] Field of Search ..... 72/254, 255

[56] References Cited

U.S. PATENT DOCUMENTS 3,129,818 4/1964 Behrendt et al. ..... 72/255

4,043,163 8/1977 Raab ..... 72/255

4,048,832 9/1977 Raab et al. ..... 72/255

*Primary Examiner*—Lowell A. Larson

*Attorney, Agent, or Firm*—Holman & Stern

[57] ABSTRACT

Apparatus for separating pressure plates from extrusion residues formed when metal is extruded so as to leave a thin shell of metal residue surrounding a pressure plate used to force the metal through the extrusion die comprises a device for pushing the pressure plate between a pair of stripping cutters which are urged resiliently against the shell on opposite sides of the path of movement of the pressure plate between the cutters, to that each stripping cutter removes a respective area of the shell from the pressure plate. For complete removal of the shell, the pressure plate may be retracted from between the cutters, turned to present a fresh portion of shell to the cutters, and then again fed between the cutters. A device may also be provided for shearing off extrusion residues at one or both ends of the pressure plate.

17 Claims, 9 Drawing Sheets

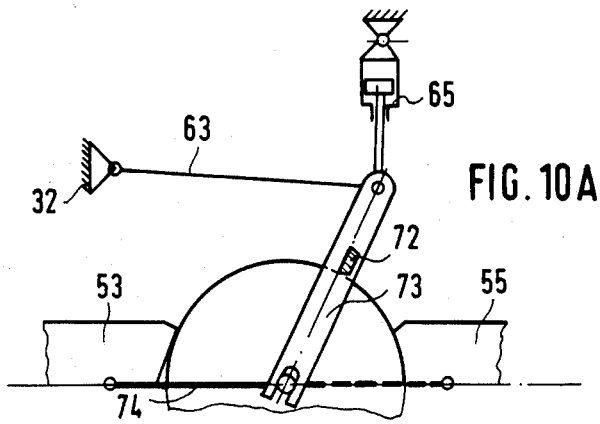
FIG. 10A
FIG. 10B
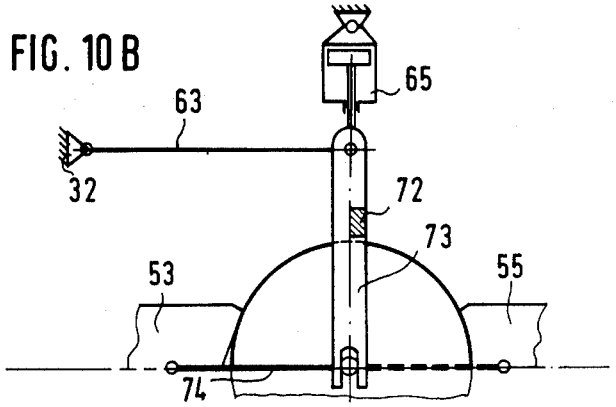
FIG. 10C
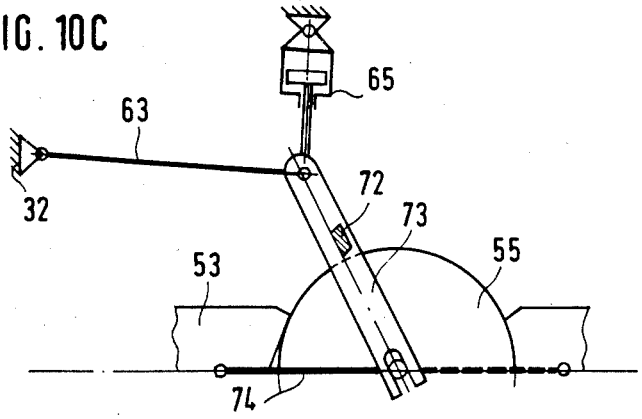

APPARATUS FOR SEPARATING PRESSURE PLATES FROM EXTRUSION RESIDUES OF METAL EXTRUDED WITH A SHELL

BACKGROUND OF THE INVENTION

1. Field of the Invention

This invention relates to apparatus for separating a pressure plate from the extrusion residue in the extrusion of metal with a shell 2. Description of the Prior Art To ensure that impurities on the surface of a billet to be deformed by extrusion do not enter the extrusion product, extrusion may be performed with a shell, particularly when raw heavy metal billets (copper or brass) are used. The pressure plate is then kept smaller in diameter than the internal diameter of the billet receiver, so that a shell approximately 0.5 to 2 mm in wall thickness remains at the bore wall in the billet receiver.

The shell is removed by means of a stripping or ejector plate, or cleaning plate, of the same diameter as the receiver bore. This can be a stripping plate connected to the pressure plate used for extrusion, with an integral neck between the pressure plate and stripping plate which leaves an empty annular chamber with space for the shell, which forms a crumpled ruff; alternatively, the ejector plate can be loaded after extrusion of a billet, and the shell can be compacted and ejected by the extrusion ram in a further ram stroke. The pressure plate must then be freed of the extrusion residue, which cmprises the shell in the vicinity of the pressure plate, the remaining shell compacted into a ruff around the neck of the pressure plate or in front of the pressure plate, and, in direct extrusion, the unextruded billet residue, whereas in indirect extrusion the unextruded billet residue is separated along the die end face while still in the press to separate the extrusion product ("Fachberichte" 18 (1980), vol. 10, pp. 951/958, and "Metall" 31 (1977), vol. 2, pp. 151/156) which corresponds to English translation "Indirect extrusion of aluminium and copper rich tubes" by F. J. Zilges, Reprint from METALLURGIA (1981) No. 5, pp. 219/228.

German Patent Specification OS Nos. 25 06 447, corresponding to U.S. Pat. No. 4,048,832 and 26 13 241 describe apparatus for separating a pressure plate from the extrusion residue in direct or indirect extrusion of metal with a shell, that is, a "pressure plate separate", more particularly one which comprises a frame, a slideway running perpendicularly up to the frame, a pusher pushing the pressure plate through the frame opening, and stripping cutters provided at the sides of the frame opening. The stripping cutters at the sides of the frame opening are so formed and spaced that they touch the pressure plates on diametrically opposite generatrices while the plates are pushed along the slideway through the frame by the pushers. The cutters are intended thus to slit open the shell or compacted shell along the two diametrically opposite generatrices, so that the remaining shell halves can be released and removed. If, as usually occurs in direct extrusion, the shell is connected to a billet residue, the frame is provided not only with the stripping cutters, but with one or two cutters above and/or below the frame opening, to cut along the pressure plate end face or faces covered by the billet residue and possibly by the compacted shell (German Patent No. 1452462, corresponding to U.S. Pat. No. 3,373,592 and German Patent Specification OS No. 25 05 160, corresponding to U.S. Pat. No. 4,043,163). Known pressure plate separates do not offer the operational reliability needed for the desired automation of the process of separating the pressure plate from the extrusion residue. Adhesion of the extrusion residue to the pressure plate or slight bonding of material in the vicinity of radii at the edges of the pressure plate occasionally interfere with satisfactory separation of the pressure plate from the extrusion residue, so that manual intervention is required.

SUMMARY OF THE INVENTION

An object of the invention is to improve the operational efficiency of pressure plate separators.

The invention provides an apparatus of the type described for separating a pressure plate from the extrusion residue wherein the stripping cutters with the cutter carriers supporting them are movable in opposite directions perpendicularly to the direction of advance of the pusher and provided with setting devices by means of which they are adjusted so as to be resilient in the direction of the pusher center, so that the stripping cutters, moving along with the pressure plate advance produced by the pusher advance, travel over a portion of the periphery of the pressure plate, changing their distance relative to one another. By this means the shell or compacted shell on two opposite peripheral portions is removed, and not merely cut open along generatrices as in the prior art.

The stripping cutters may be situated in the same area as the cutters mounted above and/or below the frame opening in the frame, which shear off the billet residue from the end face of the pressure plate and optionally the compacted shell from the front of the pressure plate, and they may cut the shell at the same time as or shortly after these cutters. This has the advantage that the entire extrusion residue remains in front of the frame, so that scrap removal need not be provided for elsewhere.

Another possibility is to place the stripping cutters behind the frame for the cutters which separate the billet residue along the end face, and optionally the compacted shell from the rear of the pressure plate, so that the stripping cutters do not come into action until the billet residue and compacted shell have been safely removed from the pressure plate and the latter carries only the shell enclosing it. This arrangement may be advantageous when the materials extruded exhibit a strong tendency to adhere to the pressure plate. In this case scrap removal must also be provided behind the frame.

De-shelling of the pressure plate over two large portions of its periphery, as provided by the invention, may suffice. For further or complete de-shelling, according to another feature of the invention, the stripping mechanism formed by the stripping cutters is provided with apparatus for returning the pressure plate and extrusion residue to the initial position and with a turning device, and after the pressure plate and extrusion residue have passed through the stripping mechanism, the plate and residue are turned through an angle corresponding to the peripheral portion covered by the stripping cutters during the first pass. Advantageously, the turning device is designed for a turning angle of 90°, and the stripping device covers with each of its two stripping cutters a portion of the pressure plate periphery extending over an arc of at least 90° or slightly more for every pass. In a particularly simple form of the turning device, according to a further feature of the invention, a rotatably mounted plate is provided in and flush with the surface of the slideway, and can be operated by a piston-cylinder unit, possibly by way of a ratchet drive.

If each stripping cutter covers only a relatively small peripheral portion of 60° or less per pass through the stripping mechanism, simple rectilinear motion of the cutters and their carriers will suffice. If, however, they are to cover larger peripheral portions per pass (for example, 90° in the preferred embodiment, so that the entire periphery of the pressure plates is covered completely in two passes between which the plate and residue are turned through 90°), according to a further feature of the invention, the stripping cutters, cutter carriers and cutter carrier guides are designed to cooperate as a guide system, by means of which the stripping cutters are guided radially relative to the pressure plate over their entire operating range. To achieve this in a particularly simple manner, according to another feature of the invention, the stripping cutters are double-bladed and constructed as rockers, the pivoting of the rocker on the cutter carrier being substantially central relative to the two blades.

For a structurally simple, reliable and inexpensive solution, according to a further feature of the invention, the cutter carrier guides are in the form of levers which are pivoted at one end on the frame of the apparatus and connected at the other end to the carrier of the possibly double-bladed stripping cutter and a setting device in the from of a piston-cylinder unit supported on the apparatus frame.

To carry the pressure plate and extrusion residue reliably forward and back through the apparatus frame and stripping mechanism, according to another feature of the invention, the forward pusher which pushes the plate and residue forwards through the frame is associated with a return pusher acting in the opposite direction, so that the two pushers can clamp the plate and residue between them, guiding them securely.

Depending on whether extrusion is direct or indirect and whether a combined pressure and stripping plate or a separate ejector plate is used, the extrusion residue (billet residue and possibly compacted shell) may adhere to the pressure plate only on its generated surface or also on its end face or even on both of its circular surfaces, so that a separating cut must also be made along the front end face and possibly even the circular rear end surface, allowance being made for the different axial dimensions, that is, the thickness of the pressure plate, and its neck and the stripping plate in the case of a combined pressure and stripping plate. To this end, according to a further feature of the invention, the upper yoke of the frame is adjustable relative to the lower yoke, and with it the opening height in the frame and the distance between the cutting edges of the cutters in the lower and upper yokes of the frame, and the slideway mounted in front of the frame is adjustable in height relative to the cutting edge of the cutter in the lower yoke of the frame.

BRIEF DESCRIPTION OF THE DRAWINGS

The invention will now be described in more detail with reference to the drawings, wherein:

FIGS. 10A, 10B and 10C are views similar to FIGS. 9A, 9B and 9C, respectively, which show a further embodiment in corresponding operating positions;

DETAILED DESCRIPTION

Figure 1A:
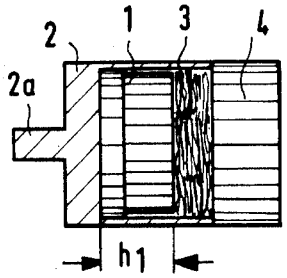
FIGS. 1A, 1B and 1C are schematic cross-sectional views which illustrate extrusion residues produced by different working methods or tools.

The extrusion residue shown in FIG. 1A is the product of direct extrusion with a shell, followed by ejection of the shell in a separate step. In front of the pressure plate 1 in this case there remains a billet residue 2 with a stump 2*a* of the separate extrusion. After retraction of the extrusion ram and loading of an ejector plate 4 the shell 3 resulting from extrusion is compacted in another advance of the ram and collects in the form of a bundle behind the pressure plate 1. To separate the plate 1 from the extrusion residue (billet residue 2 and shell 3), it is necessary to make two cuts along the front end face and rear circular surface of the plate 1 at an interval $h_1$ equal to the thickness of the plate 1, and to remove the shell 3 enclosing the plate 1.

Figure 1B:
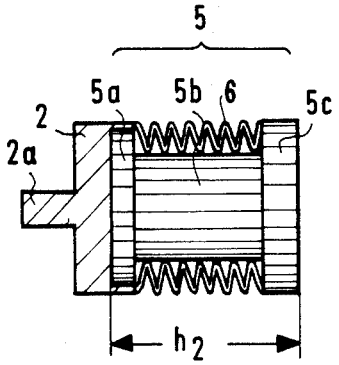
Figure 1C:
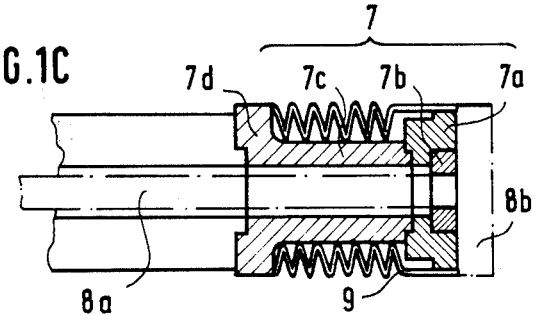
Figure 2:
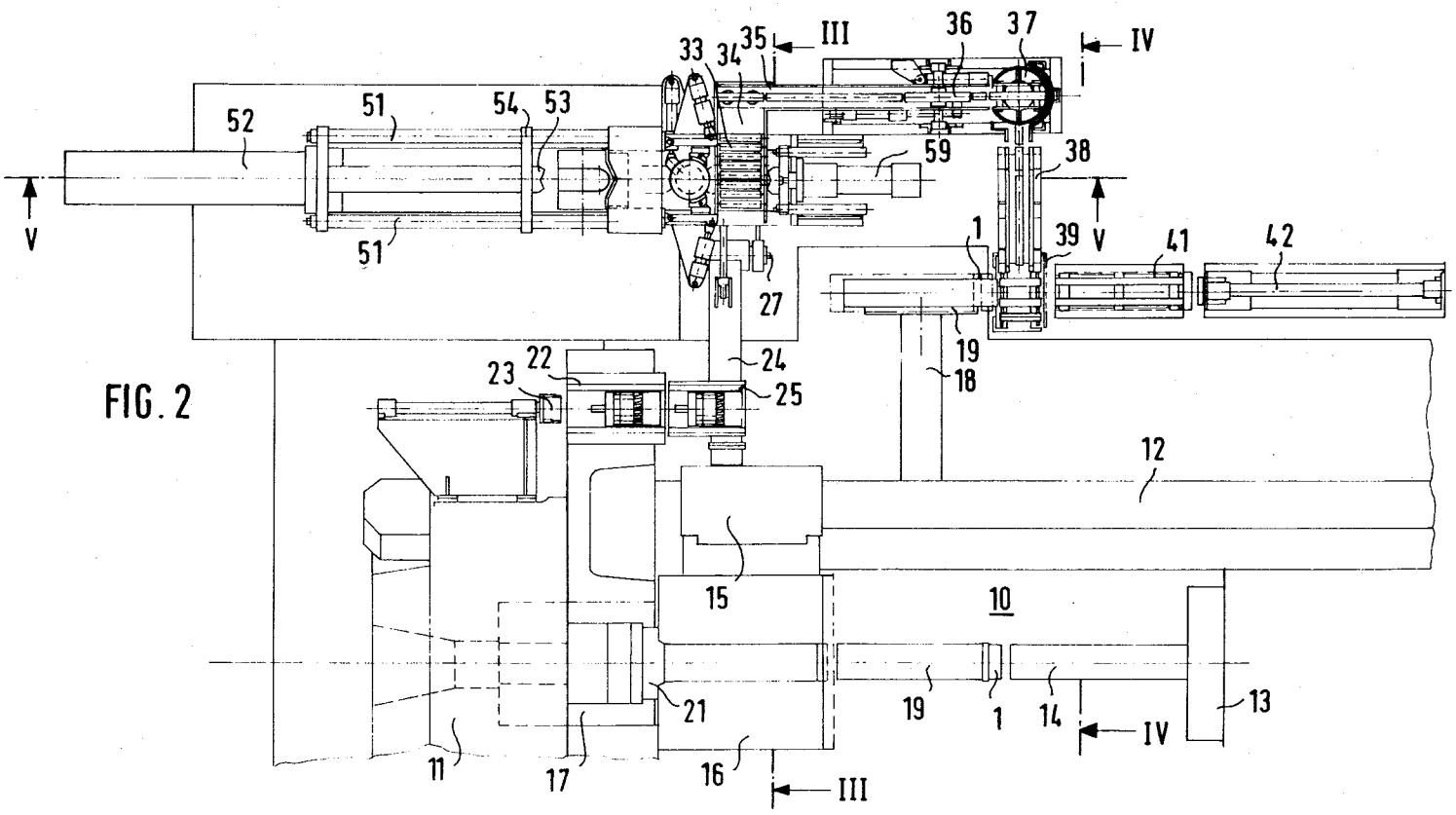
FIG. 2 is a top plan view of an embodiment of apparatus of the invention associated with an extrusion press.

The extrusion residue shown in FIG. 1B is also the product of direct extrusion with a shell, this time using a combined pressure and stripping plate 5. The plate 5 comprises the pressure plate 5*a* proper, a neck 5*b* and the stripping plate 5*c*, and may be in one or more parts. In this case, also, a billet residue 2 with a stump 2*a* of the separated extrusion remains in front of the pressure plate 5*a*. The shell 6, however, is compacted immediately during extrusion by the stripping plate 5*c*, forming a ruff which surrounds the neck 5*b* of the combined pressure and stripping plate 5. The diameter and length of the neck 5*b* are such that the empty annular chamber is large enough to take the crumpled shell 6. To separate the combined pressure and stripping plate 5 from this extrusion residue (billet residue 2 and shell 6), it is necessary to make one cut along the end face of the pressure and stripping plate 5, and to remove the shell 6 enclosing the pressure plate 5*a* and neck 5*b*. The frame of the separating apparatus must be adjusted for the opening height corresponding to the axial extent $h_2$ of the pressure and stripping plate 5.

Indirect extrusion with a shell is customarily performed with a combined pressure and stripping plate 7 comprising a pressure plate 7*a*, a die 7*b* inserted in the plate 7*a*, and a stripping plate 7*d* provided with a neck 7*c*. Here it is usual for the extrusion 8*a* to be separated from the billet residue 8*b* while still in the press, by means of a cut along the end face of the pressure plate 7*a* containing the die 7*b*, so that the pressure and stripping plate 7 is enclosed only by the shell 9 (compacted into a ruff around the neck 7c of the presure and stripping plate 7), and need only be separated from this.

In the embodiment illustrated in FIGS. 2, 3, 4 and 5 the extrusion press 10 is designed for direct extrusion. It is shown in parts, viz. a platen 11 or static crosshead, spaced from and facing a cylinder crosshead (not shown), the columns 12 connecting these, a travelling crosshead 13 with an extrusion ram 14, a receiver holder 15 with a billet receiver 16, and a tool slide or turret 17. A billet loader 18 brings a billet 19 and pressure plate 1 in front of the bore in the billet receiver 16. The billet 19 and pressure plate 1 are then pushed by the ram 14 (moved with the travelling crosshead 13) into the billet receiver 16, from which the billet 19 is then extruded by way of a die 21 supported in the tool slide 17. The billet receiver 16 is then pushed contrary to the direction of extrusion until the extrusion can be separated from the billet residue 2, except for a stump 2a, by a tool (not shown). The tool slide 17 is then moved to bring a cradle 22 onto the axis of the billet receiver 16. The ram 14 is then retracted, an ejector plate 4 is loaded, and with another stroke of the ram 14 the shell 3 remaining in the bore in the billet receiver 16 is compacted behind the pressure plate 1, and the entire bundle comprising the billet residue 2, pressure plate 1, shell 3 and ejector plate 4 is pushed out of the bilet receiver and into the cradle 22. Where a combined pressure and stripping plate 5 is used, the second stroke of the ram 14 would be unnecessary, and after the extrusion and billet residue 2 have been separated and the tool slide 17 moved sideways, the bundle comprising the billet residue 2, combined pressure and stripping plate 5 and shell 6 could be ejected immediately into the cradle 22 of the tool slide 17.

Figure 3:
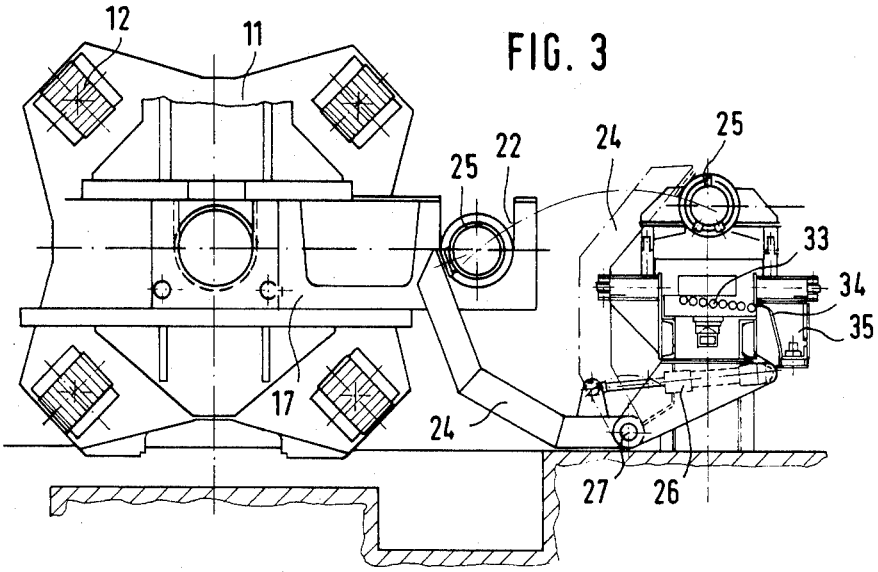
FIG. 3 is a cross-sectional view taken along line III—III in FIG. 2.
Figure 4:
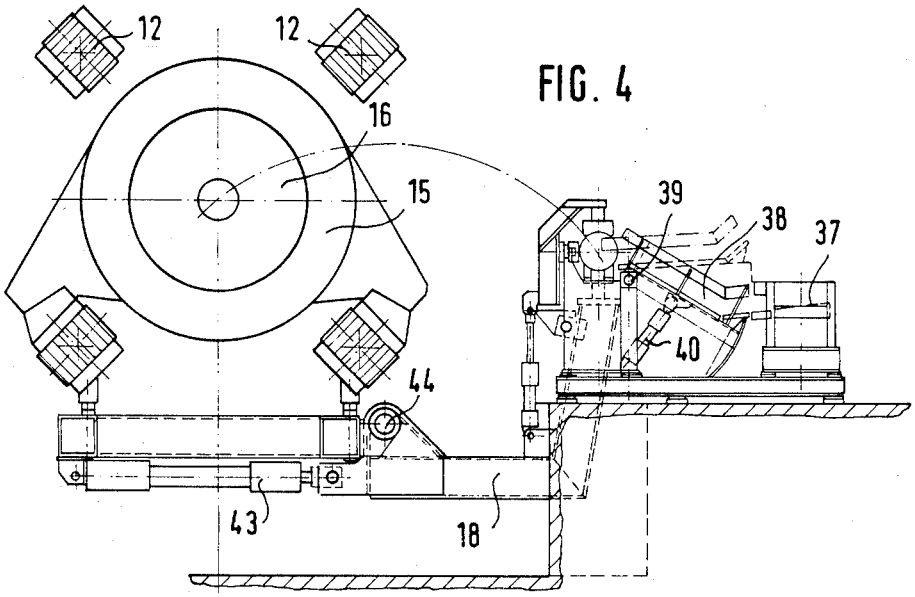
FIG. 4 is cross-sectional view taken along line IV—IV in FIG. 2.
Figure 5:
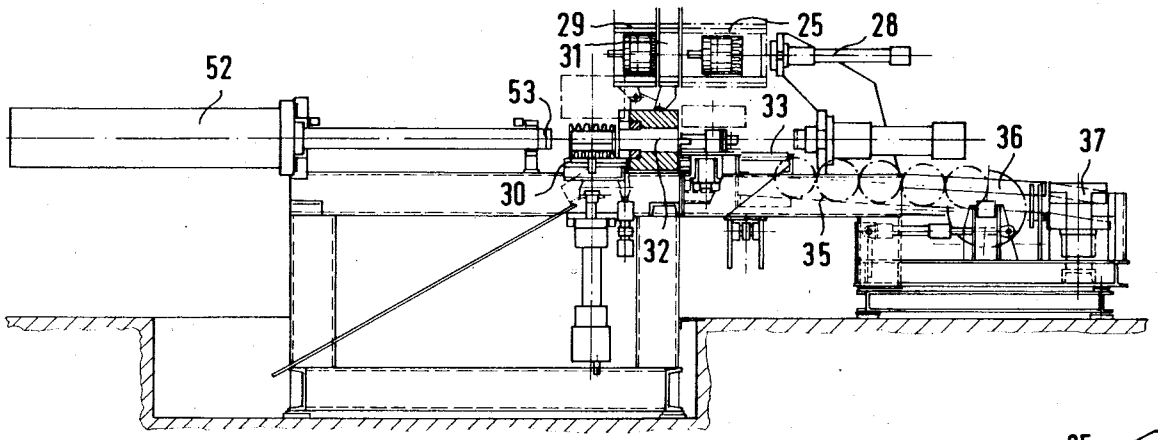
FIG. 5 is a cross-sectional view taken along line V—V in FIG. 2.

When the tool slide 17 has returned to its initial position, an ejector 23 pushes the extrusion residue bundle out of the cradle 22 of the tool slide 17 into a receiving sleeve 25 situated on the end of a pivot arm 24. As FIG. 3 shows, the arm 24 can be pivoted by a piston-cylinder unit 26 about a bearing 27 into a second position, in which the receiving sleeve 25 is coaxial with another ejector 28 and a tiltable slide 29. The residue bundle transferred from the sleeve 25 into the slide 29 by the ejector 28 is deposited on the slideway 30 of the pressure plate separate by tilting the slide 29, as shown best in FIGS. 5 and 7. By means of a second slide 31 tiltable in the opposite direction, the ejector plate 4 entrained loosely in the residue bundle can be deposited behind the frame 32 of the residue separator and fed to a store. The pressure plates 1 freed of residue in the pressure plate separator are fed—possibly alternately with ejector plates 4—by way of a roller track 33 and chute 34 to a trough 35 acting as a store. Pressure or ejector plates 1 or 4 are separated one at a time from the others by means of a rotatable lock plate 36, are turned through 90° by turning means 37 and then rolled into a rocker 38. The rocker 38 is raised about its pivot bearing 39 by a piston-cylinder unit 40, so that the pressure or ejector plates 1 or 4 arrive in a limit position which is coaxial with one of the pivoted positions of the billet loader 18, and also coaxial with a cradle 41 for receiving the billets 19 (arriving from a furnace, not shown, and heated to extrusion) and with a pusher 42. This pusher advances to the billet loader 18 first a billet 19 and then a pressure plate 1 (fed by way of the rocker 38) or, in order to remove the shell from the billet receiver 16 following an extrusion cycle, an ejector plate 4. The loader 18, operated by a piston-cylinder unit 43, then pivots in a bearing 44 to bring the billet 19 with the pressure plate 1, or ejector plate 4, in front of the bore in the billet receiver 16.

The details of the pressure plate separate will now be described in more detail with reference to FIGS. 6 and 7. The slide 29 tiltable on the frame 32 deposits an extrusion residue bundle, consisting of the pressure plate 1, the billet residue 2 with stump 2a, and the shell compacted in front of the plate 1, on the slideway 30 leading to the frame 32. The slideway 30 has a recess 45 for the stump 2a of the billet residue 2. The slideway can be adjusted vertically by a setting device 46 so that the vertical distance from the support surface for the extrusion residue to the cutting edge of a cutter 48 inserted in the lower yoke 47 of the frame 32 is equal to the thickness of the billet residue 2. The distance from the cutting edge of an upper cutter 50 inserted in an upper yoke 49 of the frame 32 to the cutting edge of the lower cutter 48 is equal to the thickness of the pressure plate 1. Tie rods 51 connect to the frame 32 a cylinder 52 in which there runs a piston acting on a pusher 53. The latter, which is movable in a guide 54, is pushed through the opening in the frame 32 until it is in the pusher position 53a. As the pusher 53 pushes the pressure plate 1 through the opening in the frame 32, the cutters 48, 50 set in the lower and upper yokes 47, 49 make cuts along the front and rear faces of the pressure plate 1; the lower cutter 48 separates the billet residue 2 and stump 2a, whereas the upper cutter 50 separates the compacted shell 3 from the pressure plate 1 and from the shell 3 enclosing it. When the pusher 53 reaches the position 53a, the pressure plate 1 and the shell 3 enclosing it enter the stripping mechanism. Here another pusher 55, which acts in opposite to the pusher 53 but with lower force, is in its position 55a. This pusher 55 is mounted on a yoke 57 connected to guide rods 56 and is moved by the piston rod 58 of a piston running in a cylinder 59. During its subsequent advance through the stripping mechanism the pressure plate 1 is gripped and positively located between the pushers 53 and 55.

Figure 9A:
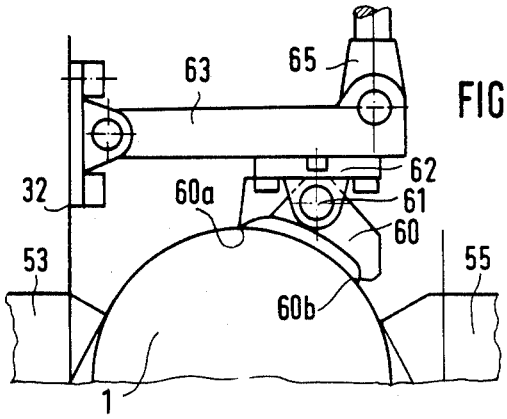
FIGS. 9A, 9B and 9C are enlarged detail view of part of the embodiment of FIGS. 2 and 6 in different operating positions.
Figure 9B:
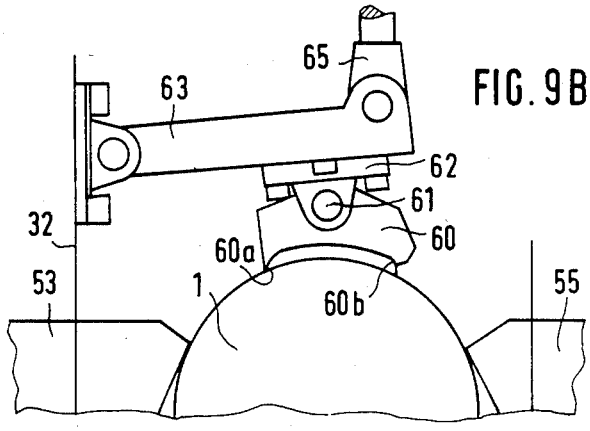
Figure 9C:
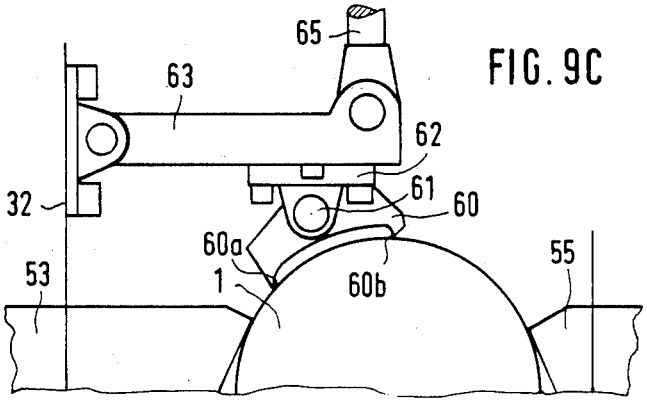

As FIGS. 9A to 9C show, the stripping mechanism comprises two stripping cutters 60 in the form of rockers. These cutters each have two blades 60a, 60b, and they are pivoted on pins 61 in cutter carriers 62. To guide the cutter carriers 62 and cutters 60, levers 63 are hinged on the frame 32, while setting means 65 engage the other ends of the levers 63, to which the cutter carriers 62 are also attached. The setting means 65 comprise respective piston-cylinder units and are supported on a bracket 64 on the frame 32. In the initial position, shown in FIG. 9A, the stripping cutters 60 come into contact with the pressure plate 1 by way of their blades 60a, 60b, which notch or bite through the shell enclosing the plate. On further advance of the plate 1 the cutters 60 run along the periphery of the pressure plate 1 with their blades 60a, 60b, removing the shell 3 until the plate 1 passes through the intermediate position in FIG. 9B into the end position shown in FIG. 9C; each stripping cutter 60, with its two blades 60a and 60b, covers an arc of rather more than 90 degrees on the periphery of the pressure plate 1, so freeing this portion from the shell 3 enclosing it. By means of the setting devices 65 the stripping cutters 60 are then lifted off the pressure plate 1, and the latter is moved back by the pushers 53, 55 into the initial position shown in FIG. 9A, so that it comes to lie on a plate 68 rotatable on a pivot 66 by a piston-cylinder unit 67. The pushers 53, 55 are then briefly released, and the unit 67 moves the plate 68, and with it the pressure plate 1, through 90°. The pushers 53, 55 and setting devices 65 are then operated again, so that in the second pass the remainder of the pressure plate periphery is freed from the shell 3 enclosing it. The shell residues removed in the stripping mechanism are fed along a chute 69 into a scrap bin. Those parts of the extrusion residue separated by the cutters 48, 50 (the billet residue 2 and compacted shell 3), which remain on the slideway 30, are passed along a chute 70 into a scrap bin after retraction of the pusher 53. To this end the slideway 30 tilts and can be adjusted by means of a piston-cylinder unit 71.

Because the stripping cutters 60 are rockers with two blades 60*a*, 60*b* and are pivoted on the cutter carriers 62, the blades 60*a*, 60*b* can always set themselves radially relative to the pressure plate 1. If single-bladed stripping cutters are used, additional means are needed to keep the stripping cutters radial relative to the pressure plate. An example is illustrated in FIGS. 10A to 10C, which correspond to the operating positions shown in FIGS. 9A to 9C, like reference numerals being used for equivalent parts. In this embodiment the stripping cutters 72 are mounted on cutter carriers 73 hinged on the levers 63. A linkage 74, which during the stripping pass can be coupled to the pusher 53 or is clamped between the pushers 53 and 55, holds the cutter carriers 73 in a radial position relative to the pressure plate 1, and the setting means 65 ensure that the stripping cutters 72 are urged onto the plate periphery.

Figure 8:
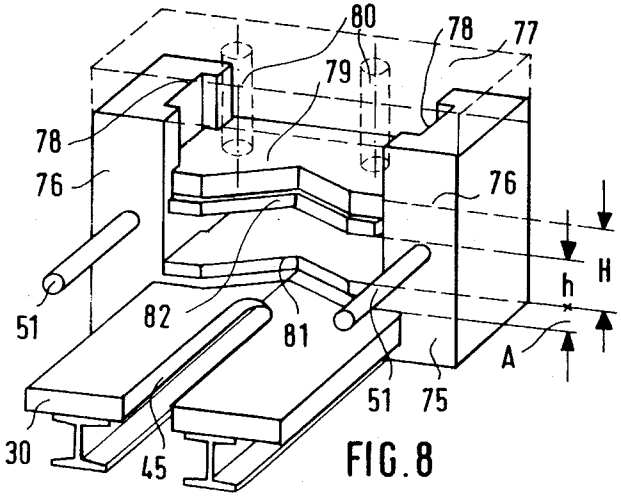
FIG. 8 is an enlarged, partial, detailed perspective view of a modification of the embodiment shown in FIGS. 2 to 7.

In the case of a uniform mode of operation (direct or indirect extrusion) with pressure plates of constant thickness, a fixed frame 32 with an invariable opening may be provided. If extrusion is always direct and with combined pressure and stripping plates, the upper cutter 50 in the frame 32 can be omitted. If all extrusion is indirect, the cutters 48 and 50 in the frame 32 can be omitted, and the slideway 30 need not be adjustable in height relative to the frame opening, since the slideway 30 in this case should be level with the lower edge of the frame opening. Otherwise it is necessary for the frame to have an adjustable opening, as in the example illustrated in FIG. 8. Here the frame consists of a lower yoke 75 which forms with limbs 76 a U-shaped frame portion which is closed by a cross-member 77. The limbs 76 are provided on the inside with guides 78, in which an upper yoke 79 is vertically movable and adjustable by setting means 80. A cutter 81 is set in the lower yoke 75, and a cutter 82 in the upper yoke 79. By adjusting the height of the slideway 30, its vertical distance A to the cutting edge of the lower cutter 81 can be adjusted according to the thickness of the billet residue 2. By adjusting the upper yoke 79 with the setting means 80, the distance between the cutting edges of the cutters 81 and 82 can be adjusted between a minimum h and a maximum H to the figure ($h_1$ or $h_2$ in FIGS. 1A and 1B) corresponding to the dimension of the pressure plate.

Figure 12:
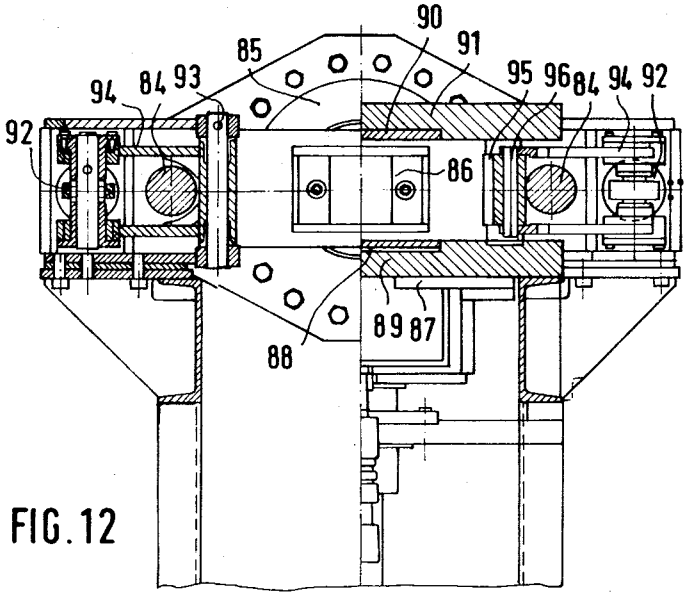
FIG. 12 is a cross-sectional view taken along line XII—XII in FIG. 11.
Figure 11:
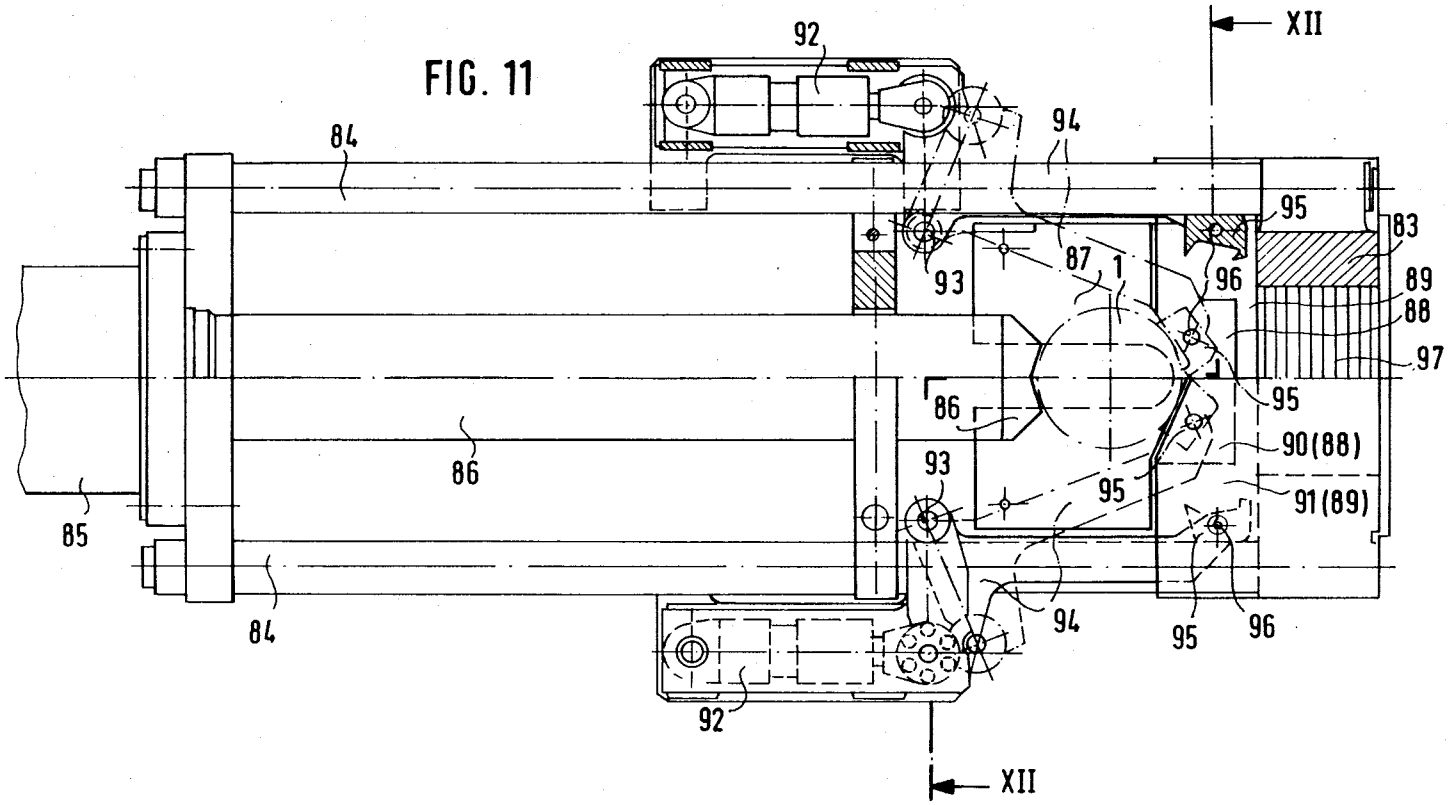
FIG. 11 is a top plan view of a further embodiment of the invention, partly cut away.

In the embodiment shown in FIGS. 11 and 12 the frame 83 is connected by tie rods 84 to a cylinder 85, from which a pusher 86 emerges to push an extrusion residue deposited on a slideway 87 into the opening in the frame 83; a lower cutter 88 in the lower yoke 89 separates the billet residue 2 along the end face of a pressure plate 1, and an upper cutter 90 in the upper yoke 91 cuts the compacted shell along the rear of the pressure plate 1, usually after only a short cutting stroke. At the same time, by way of piston-cylinder units 92 and cranks 94 mounted in pivot bearings 93, double-bladed cutters 95, designed as rockers and pivoted on the cranks 94 by means of pins 96, are brought to bear on the pressure plate 1 with the shell enclosing it. As the plate 1 is advanced by the pusher 86, the cutters 95 travel over almost the entire periphery of the plate 1, freeing it from the shell. Shell now remains only where the pusher 86 has come to bear, and even this shell has usually loosened from the plate 1. The plate 1 is advanced by the pusher 86 until it reaches the inclined surface 97 on the lower yoke 89 of the frame 93, from which it passes to a collecting chute (not shown) belonging to a store. The separated extrusion residue remains on the slideway 87 and is transferred to a scrap bin by tilting the slideway 87.

Figure 6:
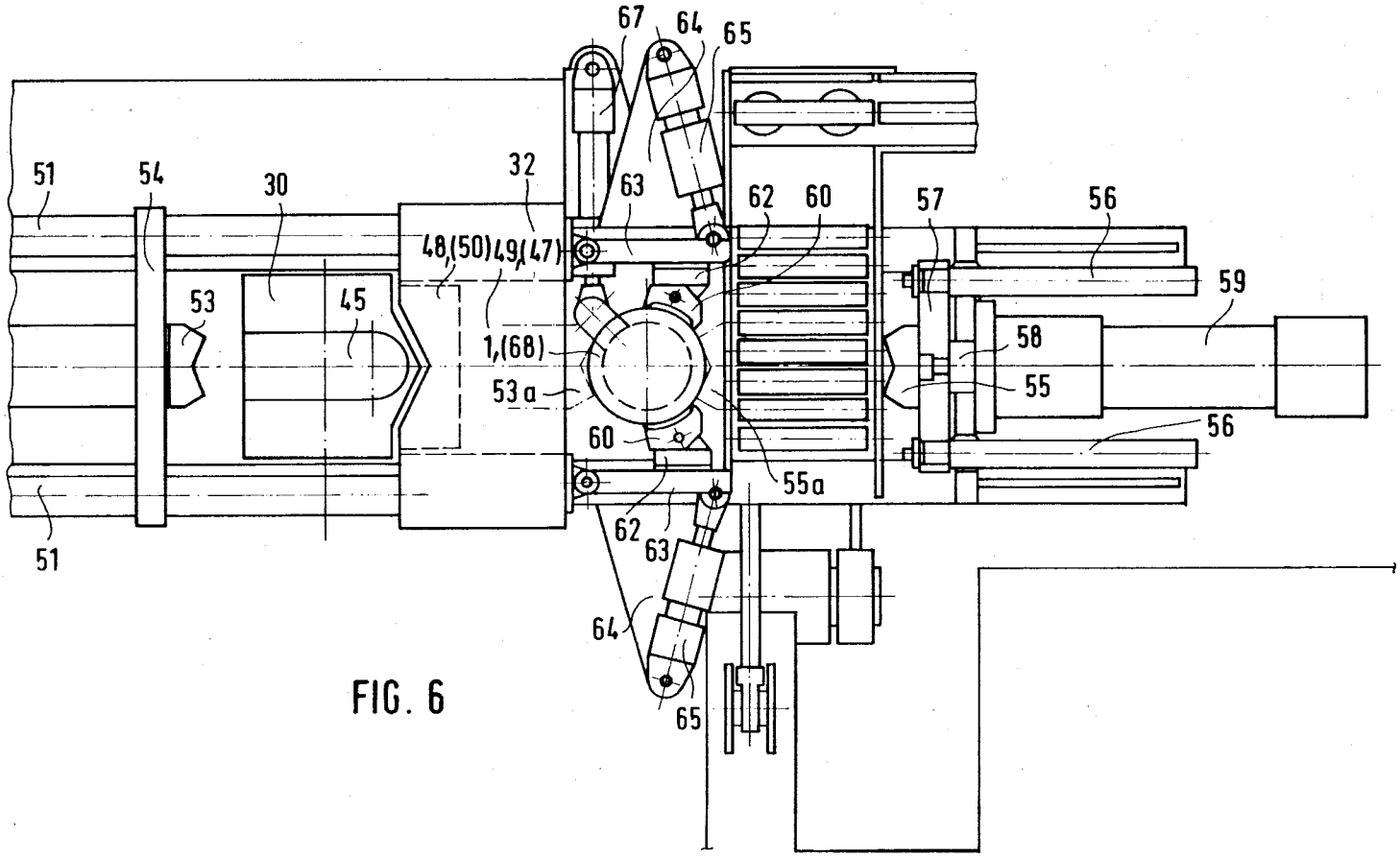
FIG. 6 is a detail view of part of FIG. 2 on a larger scale.
Figure 7:
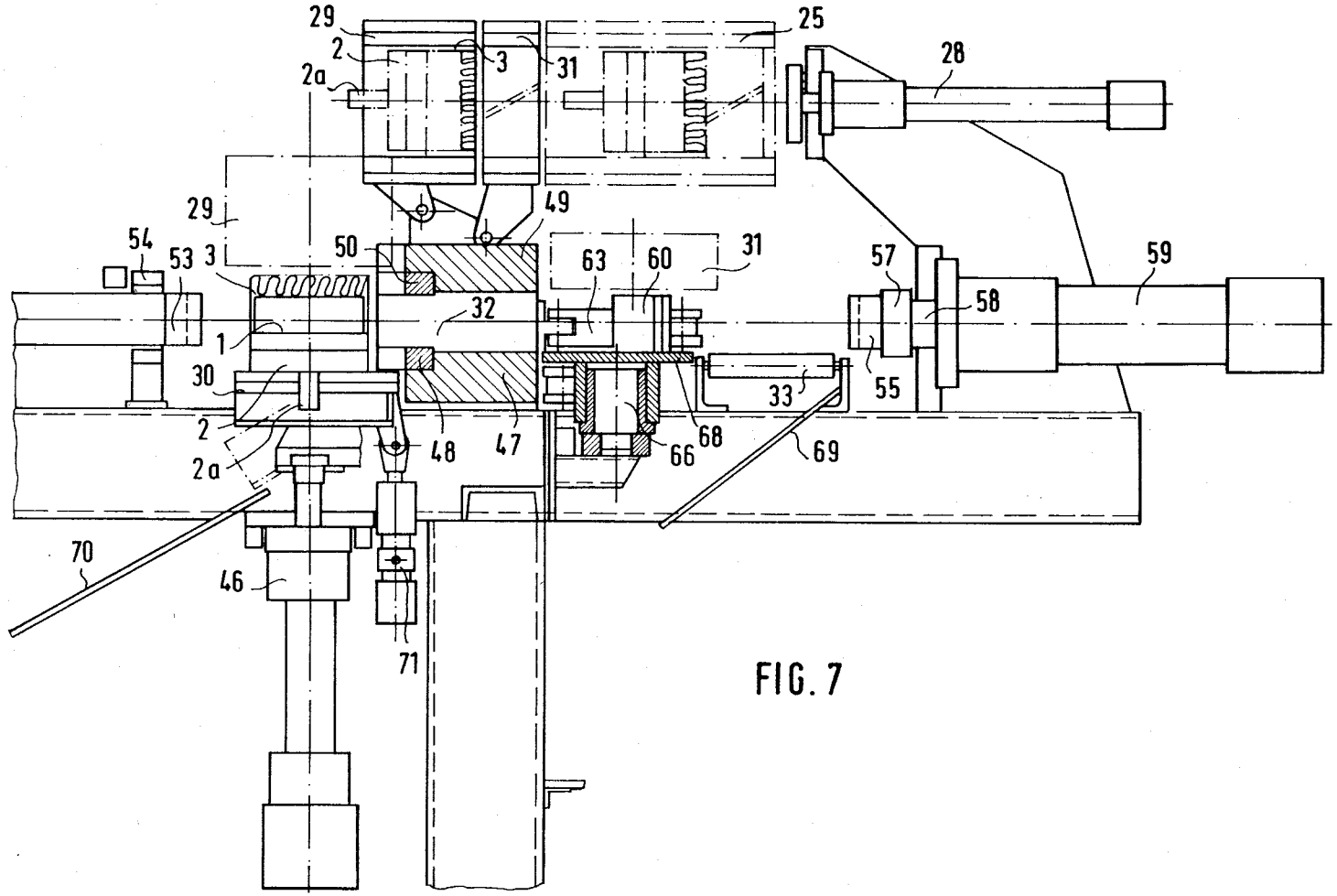
FIG. 7 is a detail view of part of FIG. 5 on a larger scale.

When the materials extruded are such that the extrusion residue is particularly difficult to separate from the pressure plate 1, apparatus as illustrated in FIGS. 11 and 12 may be followed by a second stripping mechanism, for supplementary stripping, similar to a stripping mechanism as shown in FIGS. 6 and 7.

We claim:

1. In an extrusion press for extruding metal, including an extrusion die, a pressure plate, and means for applying pressure to a body of extrudable metal through the pressure plate for extruding the metal through the die, wherein a portion of the metal forms a shell surrounding the pressure plate, apparatus for separating the pressure plate from the metal shell after extrusion, comprising:

first and second stripping cutters disposed in spaced opposite relation;

means supporting said stripping cutters for movement towards and away from one another;

means resiliently urging said stripping cutters towards one another; and feeding means for effecting relative movement of said pressure plate and shell, relative to said stripping cutters along a path passing between said stripping cutters;

so that in the course of said relative movement said stripping cutters engage said shell and traverse over respective circumferential regions of said pressure plate thereby stripping the respective regions of said shell from said pressure plate.

2. Apparatus for separating a pressure plate having an end face from an extrusion residue in the form of at least a compacted shell enclosing the pressure plate following direct or indirect extrusion of metal with a shell, comprising:

a frame having an opening whose width equals the diameter of the pressure plate plus the shell and whose height equals the thickness of the pressure plate;

a neck member on the pressure plate;

a slideway running peripendicularly up to said frame opening and locating the end face of the pressure plate at the level of said bottom edge of said frame opening;

a pusher movable over said slideway for pushing and advancing the pressure plate through said frame opening;

stripping means comprising stripping cutters on said frame at least at the sides of said frame opening which touch on diametrical generatrices the pressure plates pushed through said frame;

cutter carriers supporting said stripping cutters, said cutter carriers and stripping cutters being movable in opposite directions perpendicular to the direction of advance of the pusher; and resiliently acting settng devices directed towards the pusher center for adjusting said cutter carriers and respective stripping cutters relative to one another, so that said stripping cutters, moving along with the advance of the pressure plate produced by the pusher advance, travel over a peripheral portion of the pressure plate.

3. Apparatus as claimed in claim 2, and further comprising:

adjacent said stripping means a device for returning the pressure plate and extrusion residue into the initial position thereof prior to said advance; and a turning device for turning the pressure plate and extrusion residue thereon through an angle corresponding to that portion of the pressure plate periphery covered by a stripping cutter during an advance of said pressure plate.

4. Apparatus as claimed in claim 3, wherein:

said turning device has a turning angle of 90°; and the design of the stripping means is such that on each pass each of said stripping cutters covers a part of the pressure plate periphery extending over an arc of at least 90°.

5. Apparatus as claimed in claim 4 wherein:

said turning device comprises a rotatable plate lying in said slideway; and a piston-cylinder unit is provided for rotating said plate.

6. Apparatus as claimed in claim 3, wherein:

said turning device comprises a rotatable plate lying in said slideway; and a piston-cylinder unit is provided for rotating said plate.

7. The apparatus as claimed in claim 3 wherein said device for returning the pressure plate and extrusion residue to the initial position comprises:

a further pusher arranged and acting in opposition to said first mentioned pusher.

8. The apparatus as claimed in claim 2 wherein said stripping means comprises:

guides for cutter carriers, said guides, cutter carriers and stripping cutters being arranged to form a guide system for maintaining said stripping cutters radial relative to the pressure plate over the whole of said travel.

9. The apparatus as claimed in claim 8 wherein:

said stripping cutters comprise double-bladed cutters respectively constructed as rockers, each said rocker being pivoted on a respective cutter carrier centrally relative to the two blades of said cutter.

10. The apparatus as claimed in claim 9 and further comprising:

a frame part; and wherein each setting device comprises a piston-cylinder unit; and each guide comprises a lever pivoted on said frame part and connected to said piston-cylinder unit and to a respective cutter carrier.

11. The apparatus as claimed in claim 9 and further comprising a frame part; and wherein each setting device comprises a piston-cylinder unit; and each guide comprises a crank pivoted on said frame part and connected to said piston-cylinder unit and to a respective cutter carrier.

12. The apparatus as claimed in claim 8 and further comprising:

a frame part; and wherein each setting device comprises a piston-cylinder unit; and each guide comprises a lever pivoted on said frame part and connected to said piston-cylinder unit and to a respective cutter carrier.

13. The apparatus as claimed in claim 8 and further comprising a frame part; and wherein each setting device comprises a piston-cylinder unit; and each guide comprises a crank pivoted on said frame part and connected to said piston-cylinder unit and to a respective cutter carrier.

14. The apparatus as claimed in claim 2 and further comprising:

shearing cutters on said frame at said upper and lower edges of said frame opening, and wherein the spacing between said shearing cutters is adjustable.

15. The apparatus as claimed in claim 14 and further comprising:

means for adjusting the height of said slideway relative to said shearing cutter at said lower edge of said opening.

16. The apparatus as claimed in claim 15 wherein:

said frame comprises an upper yoke and a lower yoke; and said shearing cutters are mounted respectively on said upper and lower yokes.

17. The apparatus as claimed in claim 14 wherein:

said frame comprises an upper yoke and a lower yoke; and said shearing cutters are mounted respectively on said upper and lower yokes.

* * * * *